US010781631B2

(12) United States Patent
Huang et al.

(10) Patent No.: US 10,781,631 B2
(45) Date of Patent: Sep. 22, 2020

(54) ELECTRICALLY-DRIVEN WINDOW SHADE AND ITS ACTUATING MECHANISM

(71) Applicant: TEH YOR CO., LTD., New Taipei (TW)

(72) Inventors: Chin-Tien Huang, New Taipei (TW); Chien-Fong Huang, New Taipei (TW)

(73) Assignee: TEH YOR CO., LTD., New Taipei (TW)

( * ) Notice: Subject to any disclaimer, the term of this patent is extended or adjusted under 35 U.S.C. 154(b) by 226 days.

(21) Appl. No.: 15/845,927

(22) Filed: Dec. 18, 2017

(65) Prior Publication Data

US 2018/0298682 A1 Oct. 18, 2018

(30) Foreign Application Priority Data

Apr. 14, 2017 (TW) ..... 106112588 A

(51) Int. Cl.
*E06B 9/68* (2006.01)
*E06B 9/322* (2006.01)
*E06B 9/262* (2006.01)

(52) U.S. Cl.
CPC ..... *E06B 9/322* (2013.01); *E06B 9/262* (2013.01); *E06B 9/68* (2013.01);
(Continued)

(58) Field of Classification Search
CPC ..... E06B 9/68; E06B 2009/6809; E06B 9/70; E06B 9/72
See application file for complete search history.

(56) References Cited

U.S. PATENT DOCUMENTS 6,910,515 B2 * 6/2005 Nien ..... E06B 9/32 160/168.1 P
9,334,688 B2 * 5/2016 Colson ..... E06B 9/42
(Continued)

FOREIGN PATENT DOCUMENTS

CN 104110207 A 10/2014
CN 104763303 A 7/2015
(Continued)

OTHER PUBLICATIONS

Nov. 12, 2018 Search Report and Written Opinion from co-pending NL Patent Application No. 2020715.
(Continued)

*Primary Examiner* — Katherine W Mitchell
*Assistant Examiner* — Jeremy C Ramsey
(74) *Attorney, Agent, or Firm* — Chen Yoshimura LLP

(57) ABSTRACT

An actuating mechanism for a window shade includes an electric motor for driving a displacement of a movable rail, a motor controller electrically coupled to the electric motor and having a first and a second connector, a power supply, a wired control interface, and a removable wireless adapter operable to convert a wireless signal outputted by a wireless control interface to an electric signal. The actuating mechanism has a first configuration supporting wireless control, and a second configuration supporting wired-only control, the wireless adapter being respectively connected with the power supply, the wired control interface and the first and second connectors of the motor controller in the first configuration, and the wireless adapter being removed and the power supply and the wired control interface being respectively connected with the first and second connectors of the motor controller in the second configuration.

13 Claims, 10 Drawing Sheets

(52) U.S. Cl.
CPC ..... *E06B 2009/2627* (2013.01); *E06B 2009/3222* (2013.01); *E06B 2009/6809* (2013.01)

(56) References Cited

U.S. PATENT DOCUMENTS

| | | | | |
|---|---|---|---|---|
| 9,371,691 | B2 * | 6/2016 | Yu | E06B 9/68 |
| 10,139,791 | B2 * | 11/2018 | Lundy | G05B 11/01 |
| 2006/0086874 | A1 * | 4/2006 | Habel | E06B 9/174 248/268 |
| 2007/0221338 | A1 | 9/2007 | Meewis et al. | |
| 2014/0311686 | A1 | 10/2014 | Yu et al. | |
| 2015/0191970 | A1 | 7/2015 | Yu et al. | |
| 2017/0081917 | A1 | 3/2017 | Brunk et al. | |

FOREIGN PATENT DOCUMENTS

| | | | |
|---|---|---|---|
| CN | 106412541 | A | 2/2017 |
| EP | 2733299 | A1 | 5/2014 |
| JP | 06-185277 | A | 7/1994 |
| KR | 09-2015-0133840 | A | 11/2015 |
| KR | 10-2015-0133840 | A | 11/2015 |
| TW | I379034 | B | 12/2012 |

OTHER PUBLICATIONS

D1—Turner et al: "Electronics Etigineer's Reference Book", Nov. 30, 2016 (Nov. 30, 2016), XP055525615, GB ISBN: 978-0-408-00168-7 Found on the Internet: URL: https://web.archive.org/web/20161130145437if_http://manuals.fibaro.com:80/content.

D2—Domomat: "Micromodule récepteur encastré sans fil TYXIA 4730—1 vole montée/descente pour volet roulant / store occulatnant BSO—Delta Dore 6351347—Domomat.com", Found on the Internet: URL: https://web.archive.org/web/20160714155440/http://www.domomat.com:80/12612-micromodule-recepteur-encastre-sans-fil-tyxia-4730-1-voie-montee-descente-pour-voletroulant-store-occulatnant-bso-delta-dore-6351347.html.

Chinese Office Action, dated Jun. 18, 2019, and Search Report dated Jun. 10, 2019, in a counterpart Chinese patent application, No. CN 201710244117.8.

Korean Office Action, dated Sep. 20, 2019 in related application KR 10-2018-0034971.

* cited by examiner

ELECTRICALLY-DRIVEN WINDOW SHADE AND ITS ACTUATING MECHANISM

CROSS-REFERENCE TO RELATED APPLICATION(S)

This patent application claims priority to Taiwan Patent Application No. 106112588 filed on Apr. 14, 2017, the disclosure of which is incorporated herein by reference.

BACKGROUND

1. Field of the Invention

The present invention relates to electrically-driven window shades and its actuating mechanism.

2. Description of the Related Art

Electrically-driven window shades use an electric motor for raising and lowering the shade. The electric motor and the power source for the electric motor are usually placed in a top support structure of the window shade, and a remote controller is provided for controlling the operation of the electric motor. This type of product usually requires a specifically designed motor controller that integrates a wireless capability, which may increase the manufacture cost of the window shade.

Therefore, there is a need for a window shade that can be flexibly configured and manufactured in a cost-effective manner, and address at least the foregoing issues.

SUMMARY

An actuating mechanism for a window shade includes an electric motor for driving a displacement of a movable rail, a motor controller electrically coupled to the electric motor and having a first and a second connector, a power supply, a wired control interface, and a removable wireless adapter operable to convert a wireless signal outputted by a wireless control interface to an electric signal. The actuating mechanism has a first configuration supporting wireless control, and a second configuration supporting wired-only control, the wireless adapter being respectively connected with the power supply, the wired control interface and the first and second connectors of the motor controller in the first configuration, and the wireless adapter being removed and the power supply and the wired control interface being respectively connected with the first and second connectors of the motor controller in the second configuration.

Moreover, the present application provides a window shade including a fixed rail, a movable rail, a shading structure disposed between the fixed rail and the movable rail, an elongate tube pivotally connected with the fixed rail and extending generally vertically from the fixed rail, and the actuating mechanism, wherein the wired control interface is disposed adjacent to a lower end of the elongate tube.

DETAILED DESCRIPTION OF THE EMBODIMENTS

Figure 1:
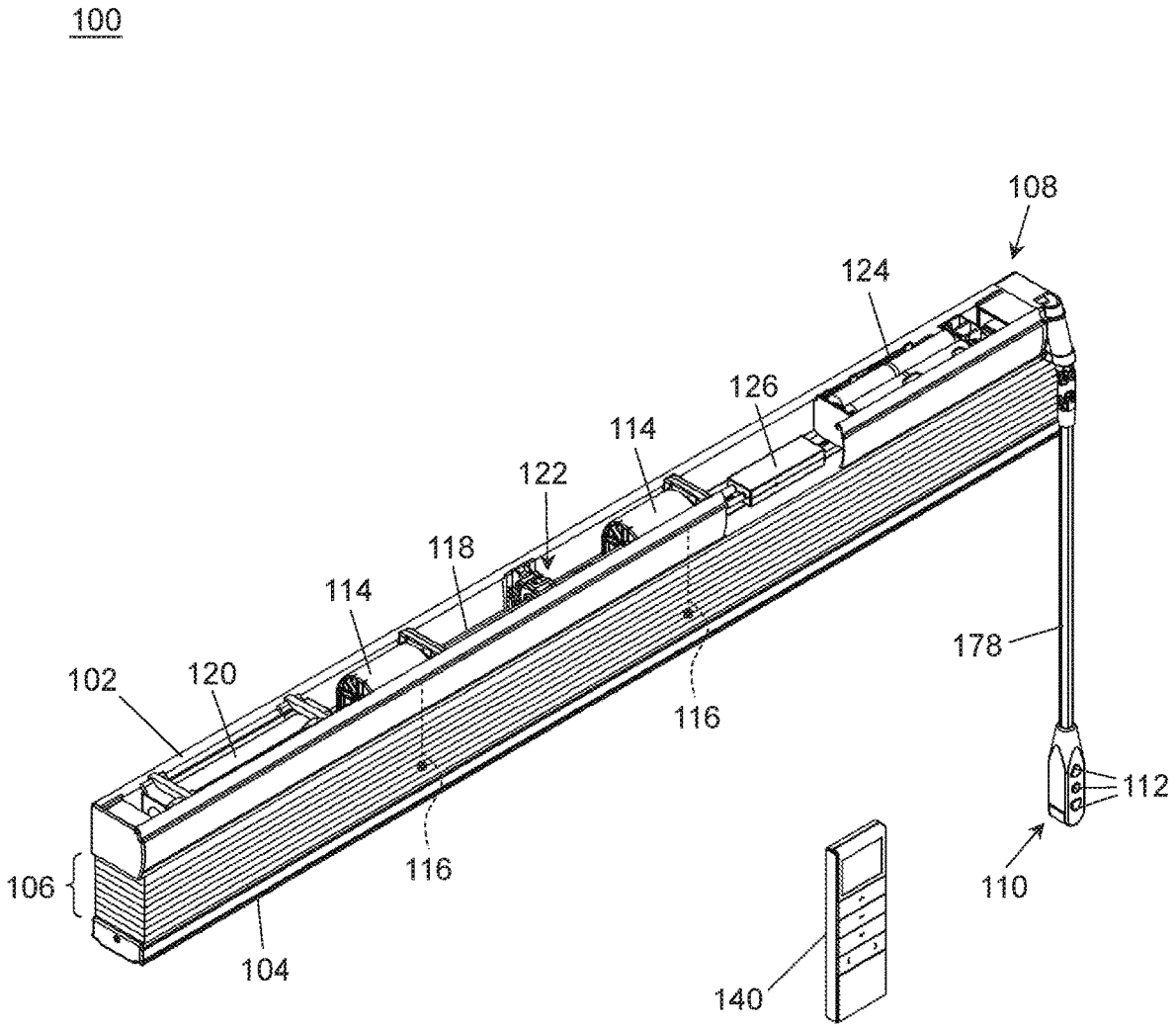
FIG. 1 is a perspective view illustrating an embodiment of an electrically-driven window shade.

FIG. 1 is a perspective view illustrating an embodiment of an electrically-driven window shade 100. The window shade 100 can be exemplary a vertically adjustable window shade. Referring to FIG. 1, the window shade 100 can include a fixed rail 102, a movable rail 104, and a shading structure 106 disposed between the fixed rail 102 and the movable rail 104. The fixed rail 102 may be a head rail that can be fixedly attached at a top of a window frame. The movable rail 104 may be a bottom rail disposed at a bottom of the window shade 100. The shading structure 106 may have an upper end disposed adjacent to the fixed rail 102, and a lower end disposed adjacent to the movable rail 104. Examples of the movable rail 104 may include, without limitation, an elongate member, a weighing member, and the like.

According to an example of construction, the shading structure 106 may have a honeycomb structure made of a fabric material that includes a plurality of expandable and collapsible cells. The upper end and the lower end of the honeycomb structure may be respectively attached to the fixed rail 102 and the movable rail 104. According other examples of construction, the shading structure 106 may include a plurality of slats suspended from the fixed rail 102.

Figure 2:
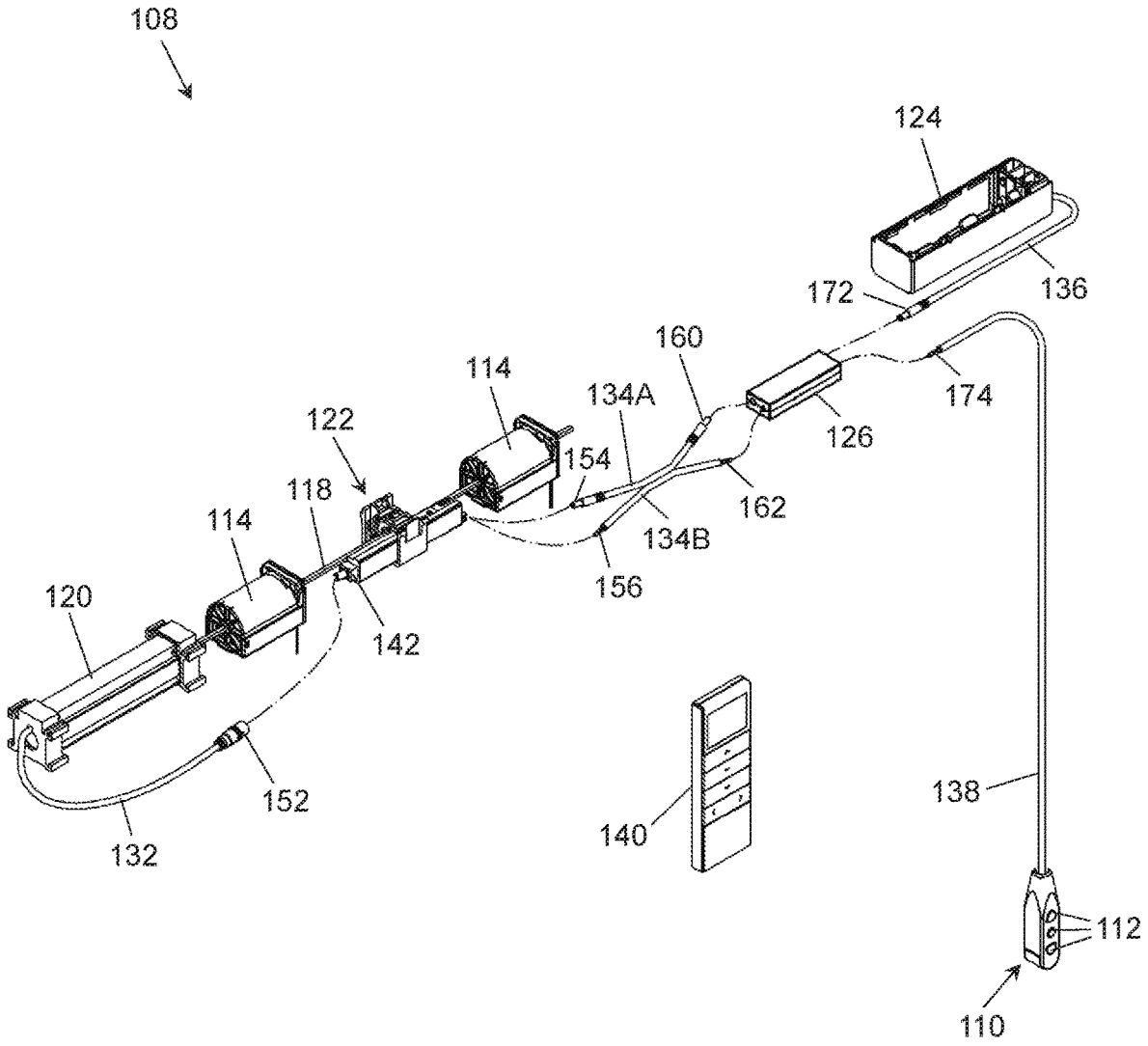
FIG. 2 is an exploded view illustrating an actuating mechanism provided in the window shade shown in FIG. 1.

In conjunction with FIG. 1, FIG. 2 is an exploded view illustrating an actuating mechanism 108 provided in the window shade 100. Referring to FIGS. 1 and 2, the window shade 100 can include an electrically-driven actuating mechanism 108, which can include a wired control interface 110, a plurality of winding units 114, a plurality of suspension cords 116 (shown with phantom lines in FIG. 1), a rotary shaft 118, an electric motor 120, a motor controller 122, a power supply 124 and a removable wireless adapter 126.

Figure 3:
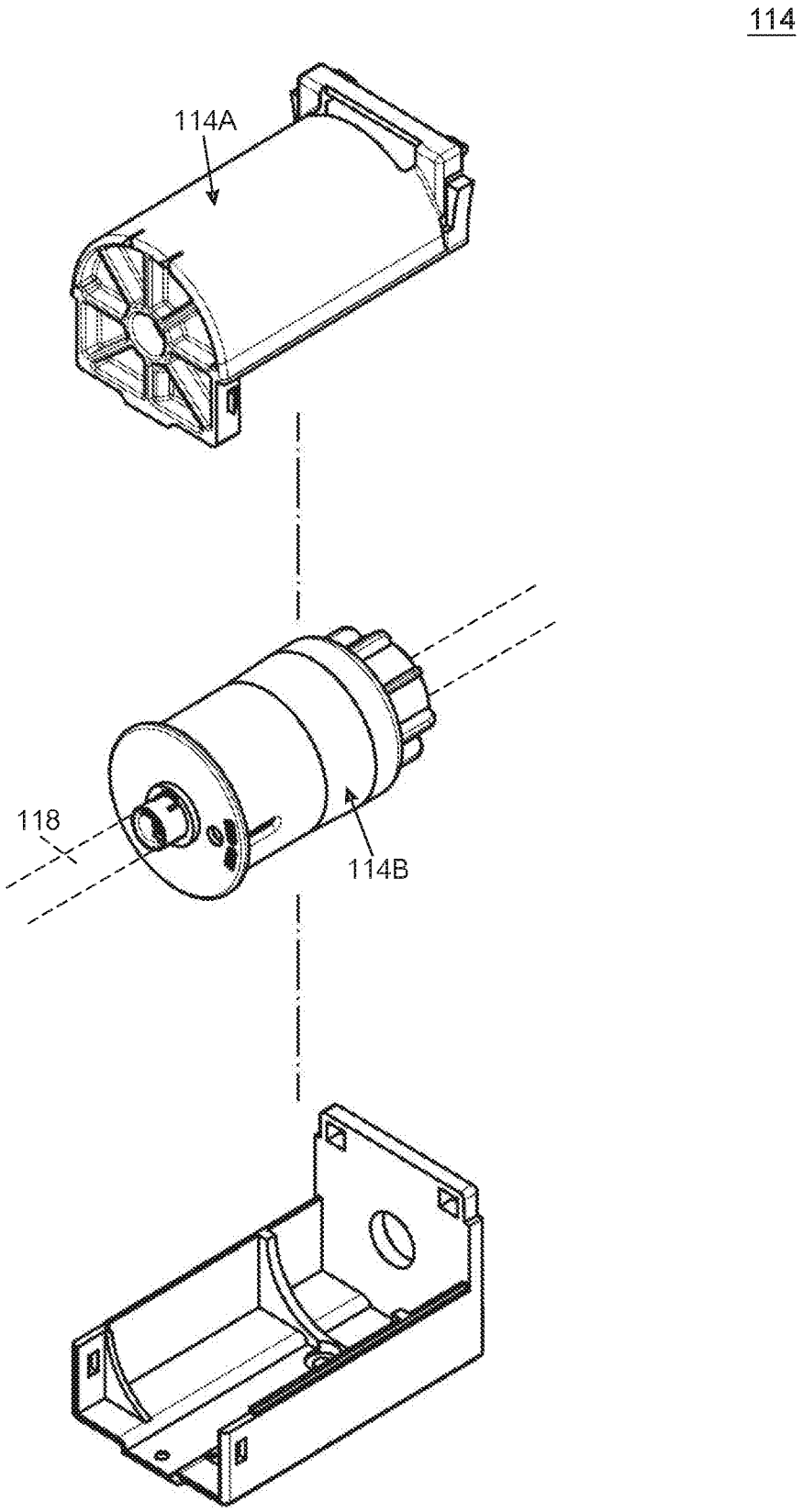
FIG. 3 is an exploded view illustrating an example of construction for a winding unit implemented in the actuating mechanism.

The winding units 114 can be disposed in the fixed rail 102 at spaced-apart locations, and can be coaxially assembled with the rotary shaft 118. FIG. 3 is an exploded view illustrating further construction details of one winding unit 114. Referring to FIG. 3, the winding unit 114 can exemplary include a casing assembly 114A and a reel 114B. The reel 114B can be pivotally connected with the casing assembly 114A and coupled to the rotary shaft 118. Accordingly, the winding unit 114 can be rotationally coupled to the rotary shaft 118. Each suspension cord 116 can be respectively connected with one winding unit 114 associated therewith. More specifically, each suspension cord 116 can pass through openings provided in the shading structure 106 with one end of the suspension cord 116 connected with the reel 114B of the winding unit 114 and another opposite end of the suspension cord 116 connected with the movable rail 104. In use, the movable rail 104 can be thereby suspended vertically below the fixed rail 102.

The rotary shaft 118 can be disposed through the reel 114B of each winding unit 114 with the reel 114B rotationally coupled to the rotary shaft 118. The rotary shaft 118 and the reels 114B of the winding units 114 can thereby rotate in unison for winding and unwinding the suspension cords 116.

The electric motor 120, the motor controller 122, the power supply 124 and the wireless adapter 126 can be respectively disposed in the fixed rail 102. The electric motor 120 can have an output rotationally coupled to the rotary shaft 118, whereby the electric motor 120 can drive the rotary shaft 118 to rotate in either direction for displacing the movable rail 104 relative to the fixed rail 102. The power supply 124 can include a battery or a voltage transformer, and can provide electric power for the actuating mechanism 108.

Figure 4:
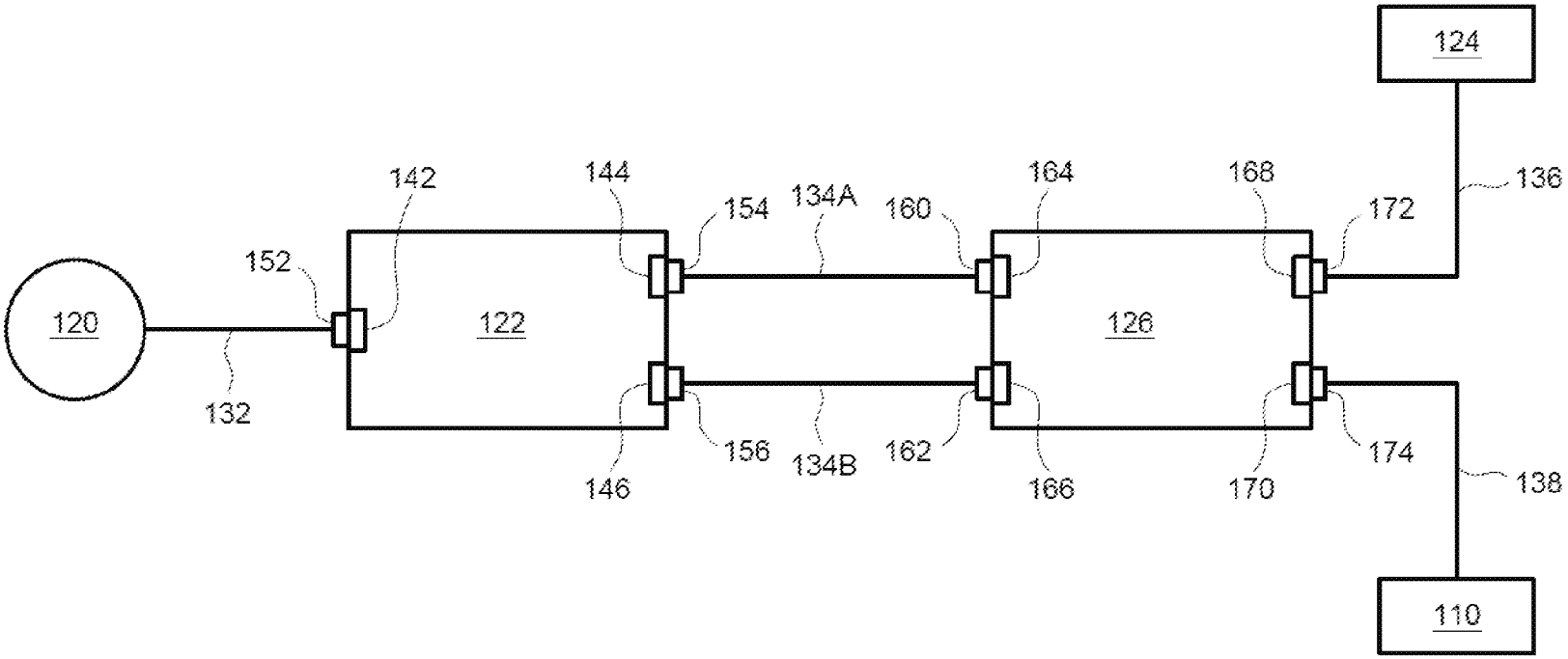
FIG. 4 is a block diagram illustrating an electric connection implemented in the actuating mechanism according to a first setup configuration supporting wireless control.

In conjunction with FIG. 2, FIG. 4 is a block diagram illustrating an electric connection implemented between the electric motor 120, the motor controller 122, the power supply 124, the wireless adapter 126 and the wired control interface 110 of the actuating mechanism 108 according to a setup configuration supporting wireless control. Referring to FIGS. 2 and 4, the motor controller 122 can be electrically connected with the electric motor 120 via a cable 132, and can be electrically connected with the wireless adapter 126 via two cables 134A and 134B. More specifically, the cable 132 can have two opposite ends respectively connected with the electric motor 120 and the motor controller 122, and each of the two cables 134A and 134B can have two opposite ends respectively connected with the motor controller 122 and the wireless adapter 126. Moreover, the wireless adapter 126 can be respectively connected electrically with the power supply 124 and the wired control interface 110 via two cables 136 and 138. More specifically, the cable 136 can have two opposite ends respectively connected with the power supply 124 and the wireless adapter 126, and the cable 138 can have two opposite ends respectively connected with the wired control interface 110 and the wireless adapter 126.

The motor controller 122 can receive an electric signal from the wireless adapter 126 and/or the wired control interface 110, perform settings, control the operation of the electric motor 120, and transfer electric power outputted by the power supply 124 to the electric motor 120. The motor controller 122 and the electric motor 120 may be disposed at spaced-apart locations, e.g., one or more winding unit 114 may be disposed between the motor controller 122 and the electric motor 120.

The wired control interface 110 can be electrically coupled to the motor controller 122, and can include a plurality of buttons 112. A user can operate any of the buttons 112 on the wired control interface 110 for controlling the operation of the actuating mechanism 108 via the motor controller 122. Exemplary operations that can be controlled with the wired control interface 110 can include performing settings, displacing the movable rail 104 toward or away from the fixed rail 102 for collapsing or expanding the shading structure 106, and the like.

The wireless adapter 126 can receive electric power outputted by the power supply 124 through the cable 136, and transfer the electric power to the motor controller 122 through the cable 134A. The motor controller 122 then can allocate the electric power to the electric motor 120 for its operation.

Moreover, the wireless adapter 126 can receive a control signal, and transmit a corresponding electric signal through the cable 134B to the motor controller 122. For example, the wireless adapter 126 can receive a wireless signal (e.g., infrared (IR) or radio-frequency (RF) signal) emitted from a wireless control interface 140, convert the wireless signal to an electric signal, and transmit the electric signal through the cable 134B to the motor controller 122. The wireless control interface 140 can exemplary include a remote controller having a plurality of buttons, a wireless device having a touch panel, and the like. In addition, the wireless adapter 126 can further receive a control signal that is outputted by the wired control interface 110 and is transmitted through the cable 138 to the wireless adapter 126, this control signal being an electric signal, and transmit this electric signal through the cable 134B to the motor controller 122. Depending on whether a user operates the wired control interface 110 or the wireless control interface 140, the wireless adapter 126 can accordingly transmit a corresponding control signal to the motor controller 122, which can thereby perform settings and/or drive the electric motor 120.

According to an embodiment, the motor controller 122 can include a plurality of connectors 142, 144 and 146. The connector 142 of the motor controller 122 can connect with an end connector 152 provided at an end of the cable 132 for electrically coupling the motor controller 122 to the electric motor 120. The cable 132 may be permanently attached to the electric motor 120 at one end, and a detachable connection can be applied between the connector 142 of the motor controller 122 and the end connector 152 at the other end of the cable 132, which may facilitate installation and removal of the electric motor 120 and the motor controller 122. For electrically coupling the motor controller 122 to the wireless adapter 126, the connector 144 of the motor controller 122 can connect with an end connector 154 provided at an end of the cable 134A, and the connector 146 of the motor controller 122 can connect with an end connector 156 provided at an end of the cable 134B. A detachable connection is applied between the connector 144 of the motor controller 122 and the end connector 154 of the cable 134A as well as between the connector 146 of the motor controller 122 and the end connector 156 of the cable 134B, whereby the wireless adapter 126 may be electrically coupled to the motor controller 122 or removed as desired.

According to an embodiment, an end of the cable 134A opposite to the end connector 154 may further have another end connector 160, and an end of the cable 134B opposite to the end connector 156 may further have another end connector 162. The end connector 160 of the cable 134A and the end connector 162 of the cable 134B can respectively connect with two connectors 164 and 166 provided at an output side of the wireless adapter 126, wherein a detachable connection can be respectively applied between the end connectors 160 and 162 and the connectors 164 and 166 so that the cables 134A and 134B can be connected with or detached from the wireless adapter 126 as desired. The connector 164 of the wireless adapter 126 can be exemplary a DC power connector, and the connector 166 of the wireless adapter 126 can be exemplary a signal connector (e.g., 4-pole connector).

Referring to FIGS. 2 and 4, the wireless adapter 126 can further have an input side provided with two connectors 168 and 170. The connector 168 of the wireless adapter 126 can connect with an end connector 172 provided at an end of the cable 136 for electrically coupling the wireless adapter 126 to the power supply 124. The cable 136 may be permanently attached to the power supply 124 at one end, and a detachable connection can be applied between the connector 168 of the wireless adapter 126 and the end connector 172 at the other end of the cable 136, which may facilitate installation and removal of the power supply 124 and the wireless adapter 126. Moreover, the connector 170 of the wireless adapter 126 can connect with an end connector 174 provided at an end of the cable 138 for electrically coupling the wireless adapter 126 to the wired control interface 110. The cable 138 may be permanently attached to the wired control interface 110 at one end, and a detachable connection can be applied between the connector 170 of the wireless adapter 126 and the end connector 174 at the other end of the cable 138, which may facilitate installation and removal of the wired control interface 110 and the wireless adapter 126.

Although the cables 136 and 138 have been described as being respectively attached permanently to the power supply 124 and the wired control interface 110, it will be appreciated that a detachable connection may be respectively applied between the cables 136 and 138 and the power supply 124 and the wired control interface 110.

Referring again to FIG. 1, the fixed rail 102 may further be pivotally connected with an elongate tube 178. The elongate tube 178 can be pivotally connected with the fixed rail 102 adjacent to one end of the fixed rail 102, the elongate tube 178 extending generally vertically outside the fixed rail 102. The cable 138 can extend through a hollow interior of the elongate tube 178, and connects with the wired control interface 110 which is disposed adjacent to a lower end of the elongate tube 178. The wired control interface 110 can be thereby appended to the fixed rail 102 via the elongate tube 178.

Referring to FIGS. 2 and 4, the end connector 172 of the cable 136 can be identical to the end connector 154 of the cable 134A, and the end connector 174 of the cable 138 can be identical to the end connector 156 of the cable 134B. Accordingly, the end connector 172 of the cable 136 and the end connector 174 of the cable 138 may be respectively connected directly with the connectors 144 and 146 of the motor controller 122 in case a desired configuration does not need the wireless adapter 126. Therefore, the actuating mechanism 108 of the window shade 100 described herein can have at least two setup configurations, which include a setup configuration supporting wired-only control and a setup configuration supporting wireless control.

Figure 5:
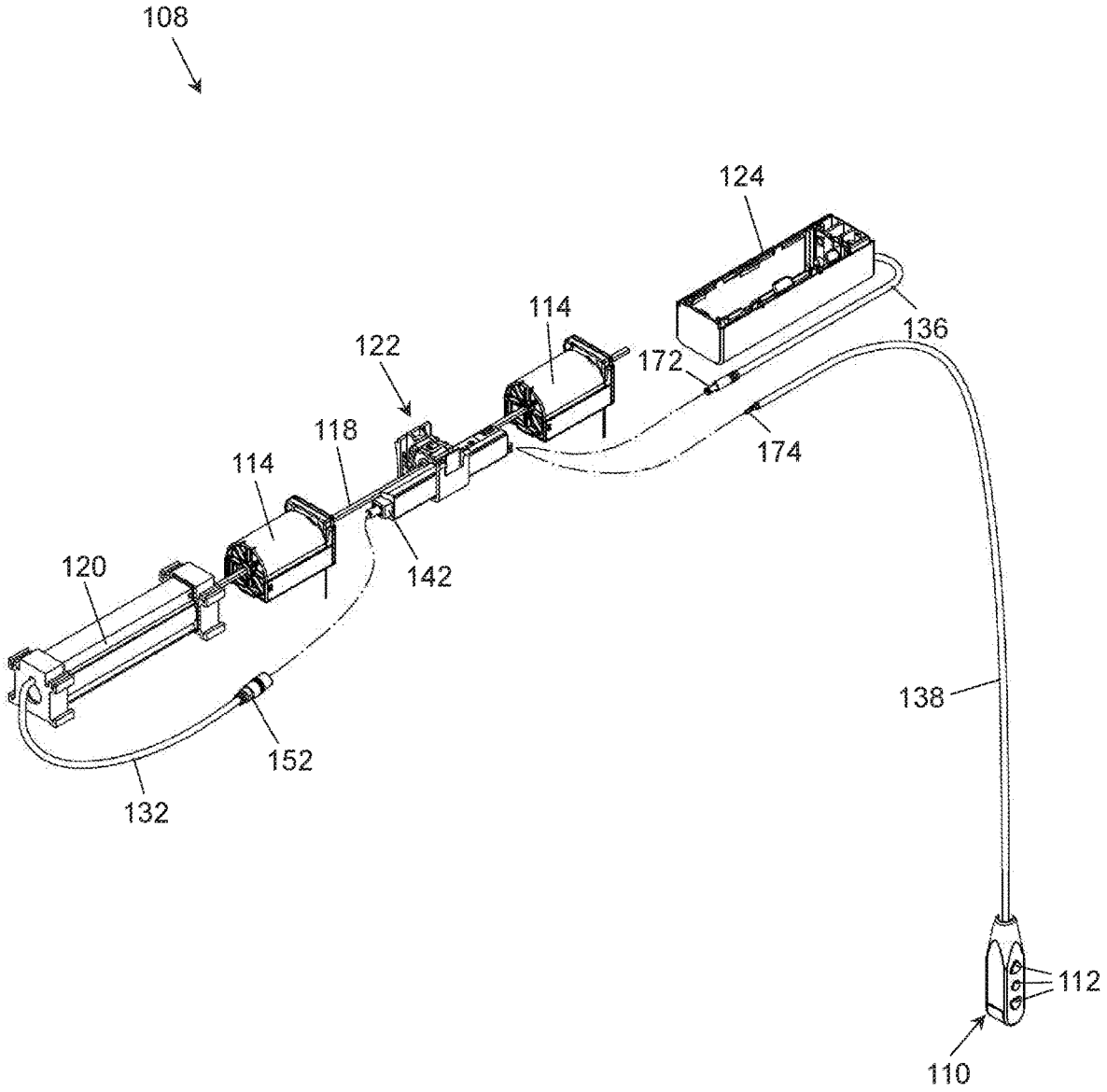
FIG. 5 is a perspective view illustrating the actuating mechanism in a setup configuration supporting wired-only control.
Figure 6:
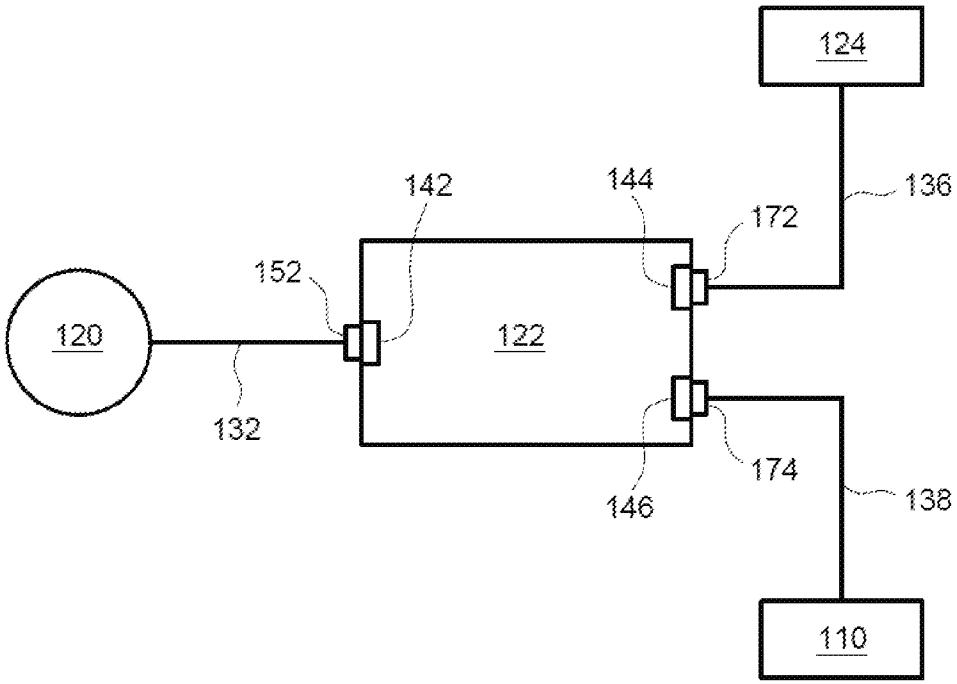
FIG. 6 is a block diagram illustrating the actuating mechanism in a setup configuration supporting wired-only control.

FIGS. 5 and 6 are respectively a perspective view and a block diagram illustrating the actuating mechanism 108 in a setup configuration supporting wired-only control. Referring to FIGS. 5 and 6, when no wireless control is needed, the wireless adapter 126 and the cables 134A and 134B (better shown in FIG. 2) can be removed, the cable 136 of the power supply 124 can be connected with the connector 144 of the motor controller 122 by having the end connector 172 of the cable 136 connected and in contact with the connector 144, and the cable 138 of the wired control interface 110 can be connected with the connector 146 of the motor controller 122 by having the end connector 174 of the cable 138 connected and in contact with the connector 146. Moreover, the motor controller 122 can be electrically coupled to the electric motor 120 through the cable 132 by having the end connector 152 of the cable 132 connected and in contact with the connector 142 on the motor controller 122. With respect to a spatial placement, the electric motor 120 and the power supply 124 can be respectively disposed adjacent to two opposite ends of the fixed rail 102, and the motor controller 122 and the electric motor 120 may be spaced apart from each other with the motor controller 122 exemplary disposed between two winding units 114.

Figure 7:
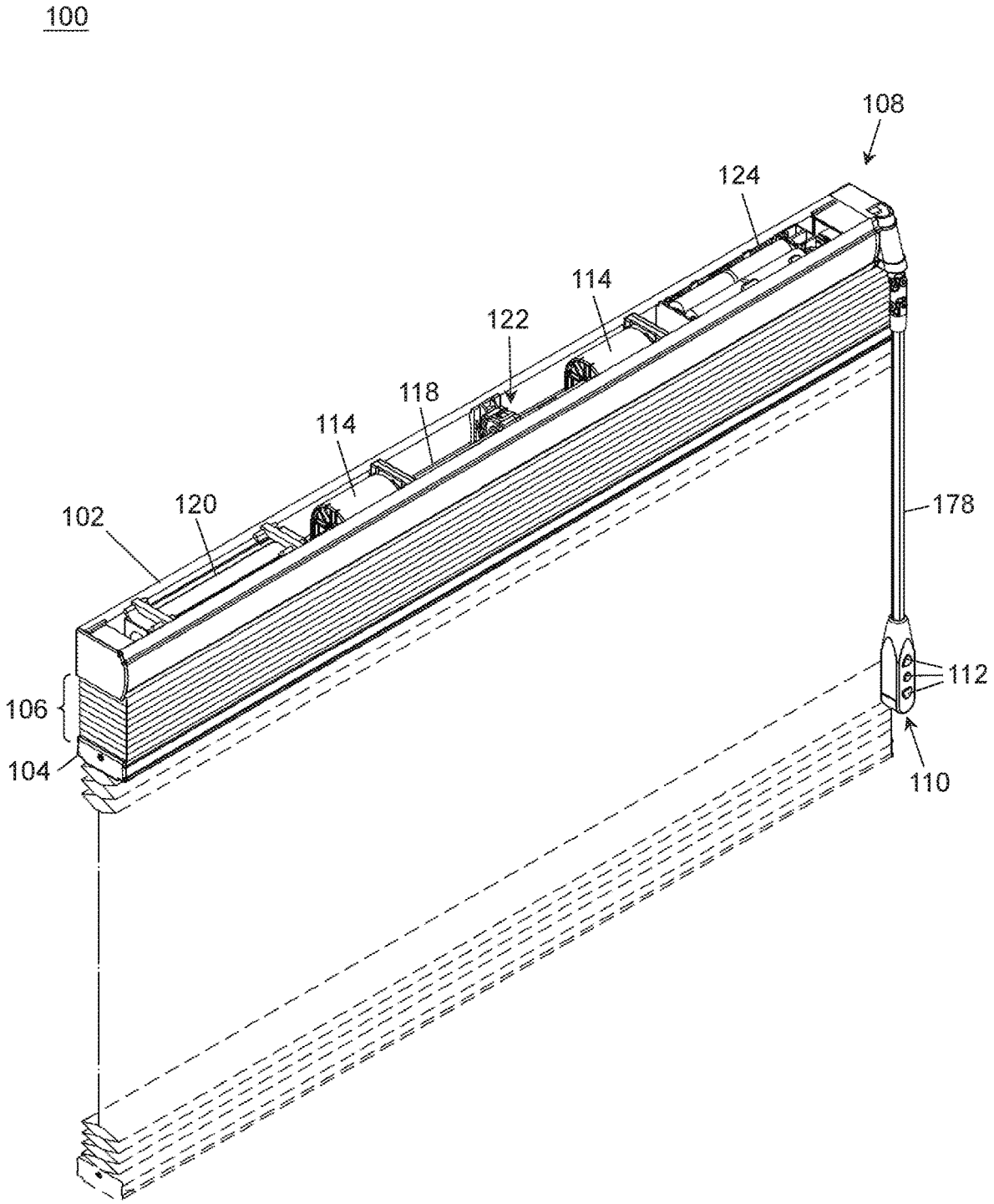
FIG. 7 is a perspective view illustrating exemplary operation of the window shade in the setup configuration supporting wired-only control.

When the actuating mechanism 108 is in the setup configuration shown in FIGS. 5 and 6, only wired control is available: a user can send commands to the motor controller 122 with only the buttons 112 on the wired control interface 110. For example, when a user operates one or more of the buttons 112, the wired control interface 110 can transmit a control signal through the cable 138 to the motor controller 122 for performing the corresponding operation, such as performing settings and/or displacing the movable rail 104 as exemplary shown in FIG. 7.

Referring to FIGS. 1, 2 and 4, when the window shade 100 needs to support wireless control, the wireless adapter 126 can be installed in the fixed rail 102. With respect to the electric connection, the cable 136 of the power supply 124 can be connected with the connector 168 on the input side of the wireless adapter 126 by having the end connector 172 of the cable 136 connected and in contact with the connector 168, and the cable 138 of the wired control interface 110 can be connected with the connector 170 on the input side of the wireless adapter 126 by having the end connector 174 of the cable 138 connected and in contact with the connector 170. Moreover, the cable 134A can be respectively connected with the connector 144 on the motor controller 122 and the connector 164 on the output side of the wireless adapter 126 by having the end connectors 154 and 160 of the cable 134A respectively connected and in contact with the connectors 144 and 164, and the cable 134B can be respectively connected with connector 146 on the motor controller 122 and the connector 166 on the output side of the wireless adapter 126 by having the end connectors 156 and 162 of the cable 134B respectively connected and in contact with the connectors 146 and 166. The wireless adapter 126 can be thereby respectively connected with the power supply 124, the wired control interface 110, and the connectors 144 and 146 of the motor controller 122. In addition, the motor controller 122 can electrically couple to the electric motor 120 through the cable 132 by having the end connector 152 of the cable 132 connected and in contact with the connector 142 on the motor controller 122. With respect to a spatial placement, the electric motor 120 and the power supply 124 can be respectively disposed adjacent to two opposite ends of the fixed rail 102, and the motor controller 122 and the electric motor 120 may be spaced apart from each other with the motor controller 122 exemplary disposed between two winding units 114. The wireless adapter 126 can be exemplary disposed adjacent to the power supply 124 and spaced apart from the motor controller 122.

Figure 8:
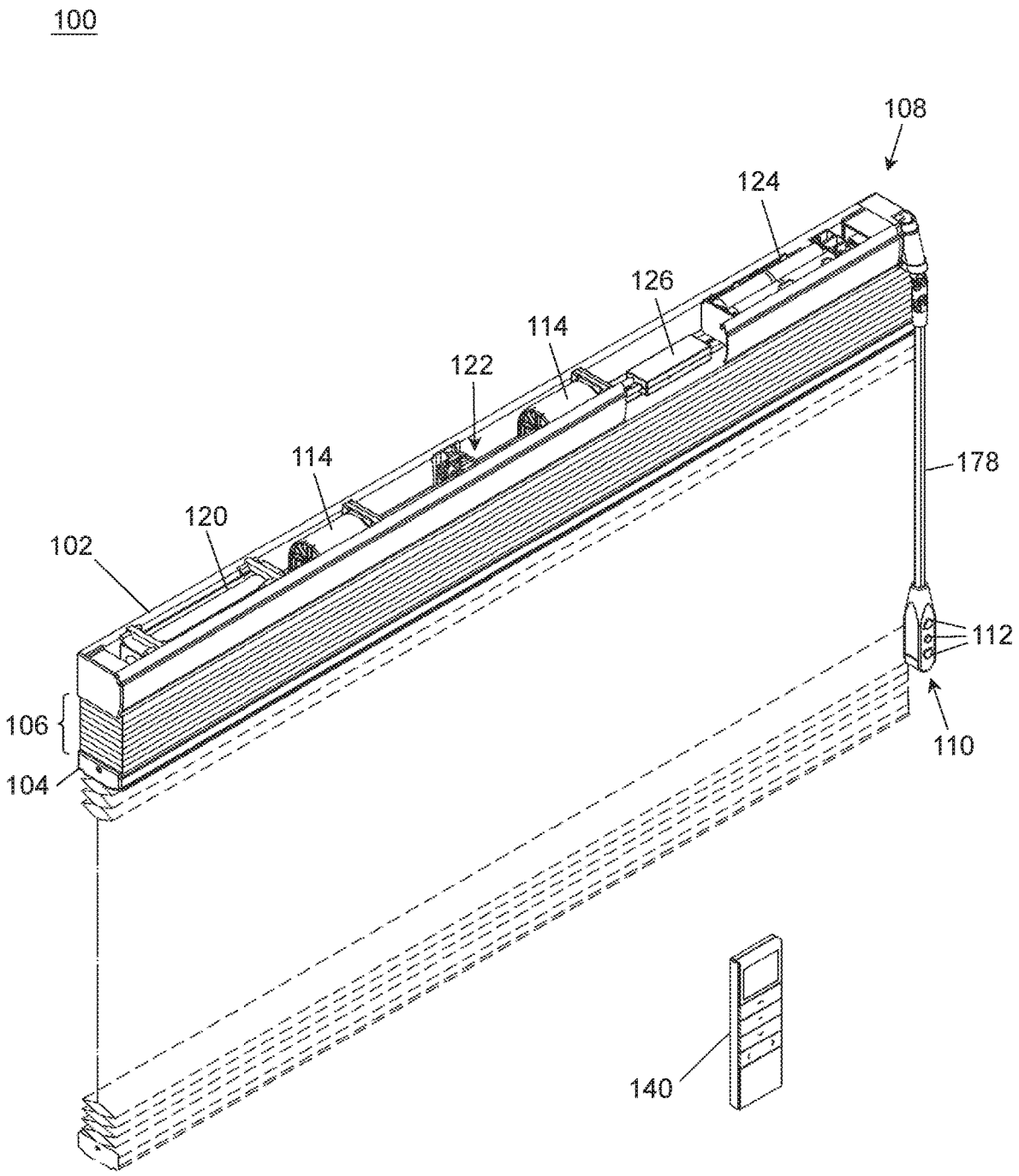
FIG. 8 is a perspective view illustrating exemplary operation of the window shade in the setup configuration supporting wireless control.

When the actuating mechanism 108 is in the setup configuration shown in FIGS. 1, 2 and 4, a user can send commands to the motor controller 122 with the wireless control interface 140 for performing settings and/or displacing the movable rail 104 as shown in FIG. 8. More specifically, when a user operates the wireless control interface 140, the wireless control interface 140 can emit a wireless signal to the wireless adapter 126. The wireless adapter 126 then can transmit a corresponding control signal through the cable 134B to the motor controller 122, which can perform a corresponding operation, such as performing a setting and/or driving the electric motor 120 in rotation.

It is noted that in the setup configuration supporting wireless control, the wireless adapter 126 can also transmit control signals outputted by the wired control interface 110 to the motor controller 122. Accordingly, a user can also use the wired control interface 110 to control operation of the window shade 100, such as performing a setting and/or driving the electric motor 120.

Figure 9:
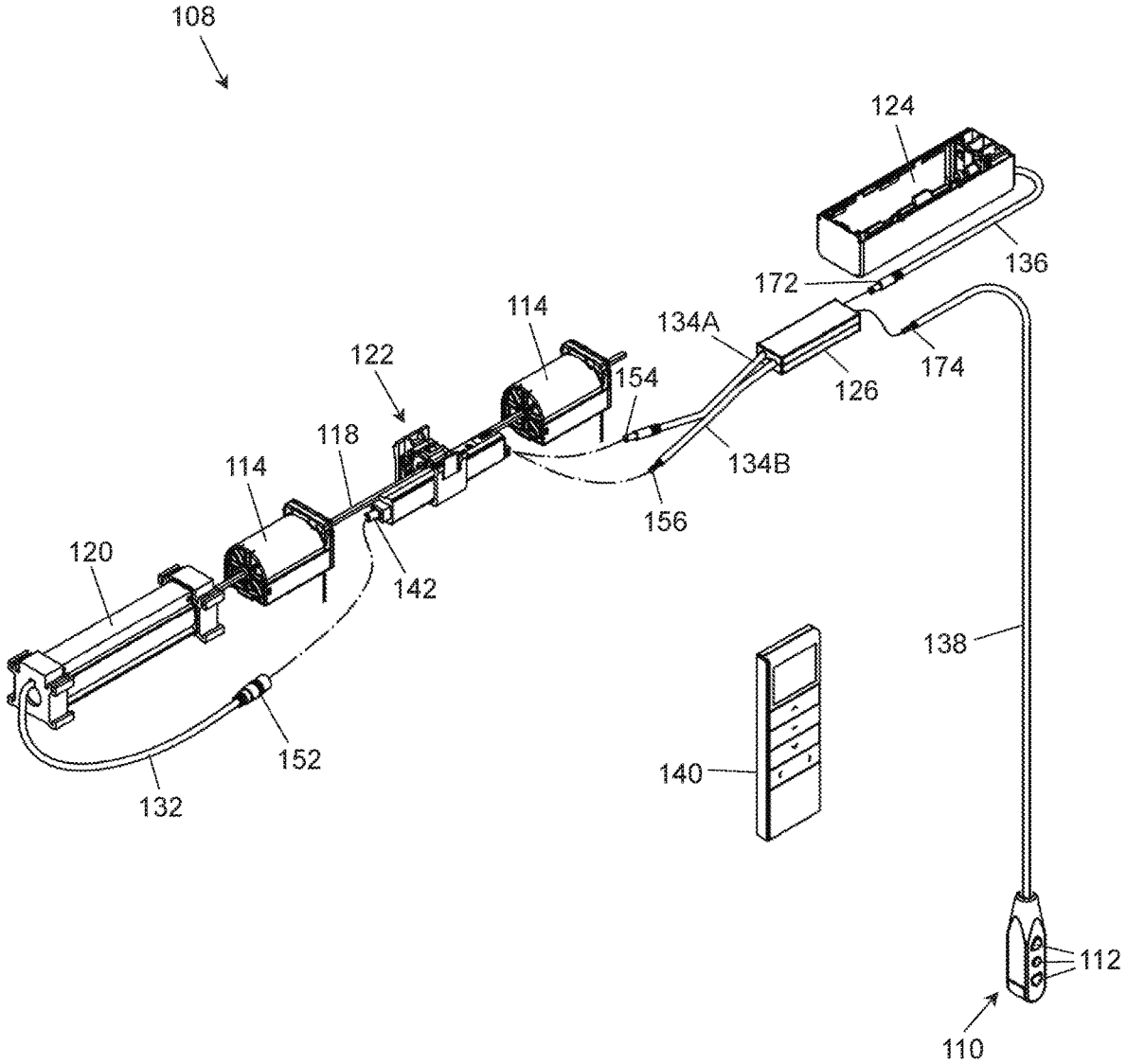
FIG. 9 is a perspective view illustrating a variant construction implemented in the actuating mechanism.
Figure 10:
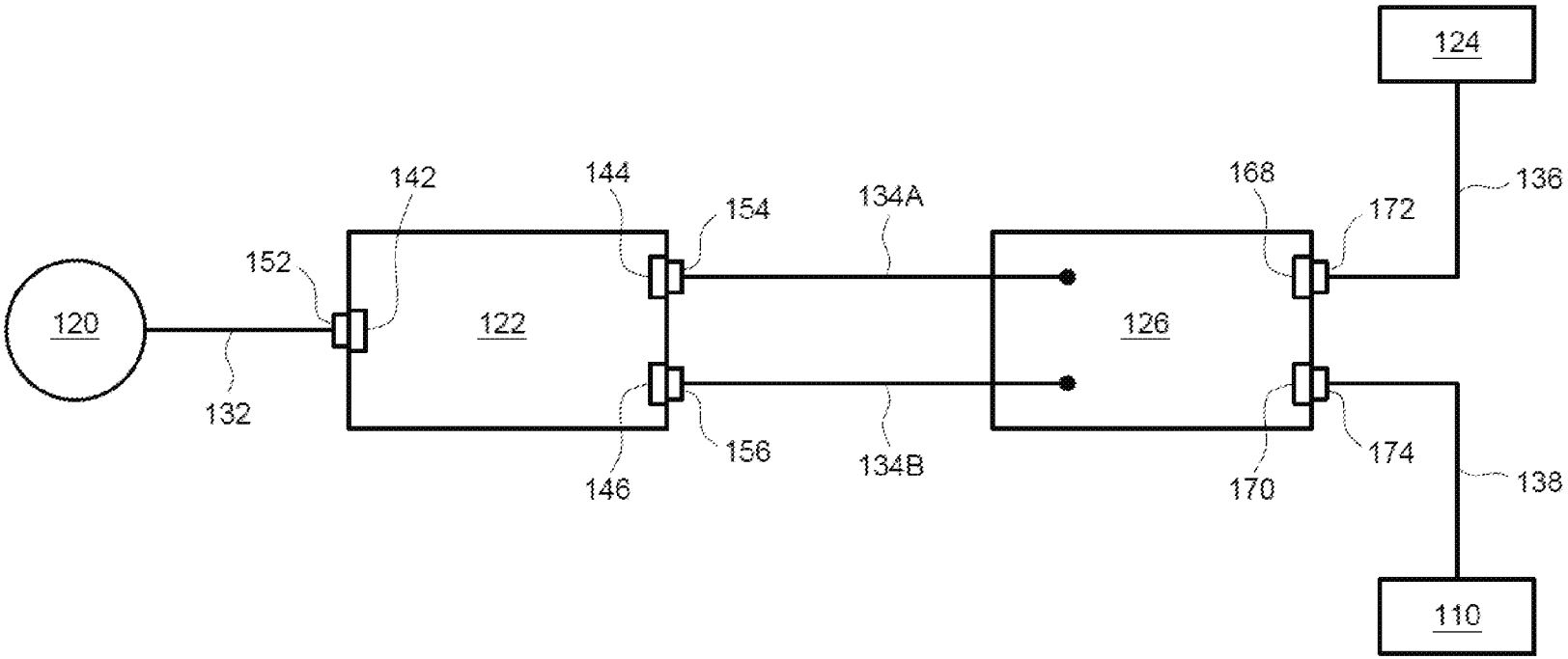
FIG. 10 is a block diagram illustrating an electrical connection implemented in the actuating mechanism shown FIG. 9 according to a setup configuration supporting wireless control.

FIGS. 9 and 10 are respectively a perspective view and a block diagram illustrating a variant implementation in which the cables 134A and 134B can be permanently attached to the wireless adapter 126, e.g., by having an end of each of the cables 134A and 134B welded to the wireless adapter 126. In other words, the cables 134A and 134B can be respectively coupled to the connectors 168 and 170 of the wireless adapter 126 via an internal circuit of the wireless adapter 126. Accordingly, the cables 134A and 134B cannot be detached from the wireless adapter 126 in use. With this construction, when the window shade 100 needs to support wireless control, the cable 136 of the power supply 124 can be connected with the connector 168 of the wireless adapter 126 by having the end connector 172 of the cable 136 connected and in contact with the connector 168, and the cable 138 of the wired control interface 110 can be connected with the connector 170 of the wireless adapter 126 by having the end connector 174 of the cable 138 connected and in contact with the connector 170. Moreover, the cable 134A of the wireless adapter 126 can be connected with the connector 144 of the motor controller 122 by having the end connector 154 of the cable 134A connected and in contact with the connector 144, and the cable 134B of the wireless adapter 126 can be connected with the connector 146 of the motor controller 122 by having the end connector 156 of the cable 134B connected and in contact with the connector 146. Like previously described, the motor controller 122 can electrically couple to the electric motor 120 via the cable 132 by having the end connector 152 of the cable 132 connected and in contact with the connector 142 of the motor controller 122.

Advantages of the structures described herein include an actuating mechanism having a modularized construction that can be implemented in a cost-effective manner. The actuating mechanism can include a wireless adapter that is easily installable or removed as desired by a manufacturer, a vendor at a point of sale, or even an end user. Accordingly, the actuating mechanism and the window shade described herein can offer more flexibility to support wireless control or wired-only control in accordance with the needs.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. An actuating mechanism for a window shade, comprising:

an electric motor for driving a displacement of a movable rail;

a motor controller electrically coupled to the electric motor, the motor controller having a first and a second connector;

a power supply;

a wired control interface; and a removable wireless adapter operable to convert a wireless signal outputted by a wireless control interface to an electric signal;

wherein the wireless adapter has a third connector and a fourth connector, the power supply is connected with a first cable having a fifth connector, and the wired control interface is connected with a second cable having a sixth connector, the actuating mechanism having a first configuration supporting wireless control, and a second configuration supporting wired-only control, the wireless adapter being respectively connected with the power supply, the wired control interface and the first and second connectors of the motor controller in the first configuration, the fifth connector and the sixth connector being respectively connected and in contact with the third connector and the fourth connector of the wireless adapter in the first configuration, and the wireless adapter being removed and the power supply and the wired control interface being respectively connected with the first and second connectors of the motor controller in the second configuration, the fifth connector and the sixth connector being respectively connected and in contact with the first connector and the second connector of the motor controller in the second configuration, wherein the wireless adapter further has a seventh and an eighth connector that respectively have identical structures as the fifth and sixth connectors, the seventh and eighth connectors being respectively connected with the first and second connectors of the motor controller in the first configuration.

2. The actuating mechanism according to claim 1, wherein the power supply is permanently attached to the first cable, and the wired control interface is permanently attached to the second cable.

3. The actuating mechanism according to claim 1, wherein the third connector of the wireless adapter is a DC power connector, and the fourth connector of the wireless adapter is a signal connector.

4. The actuating mechanism according to claim 1, wherein the wireless adapter and the motor controller are spaced apart from each other in the first configuration, the wireless adapter being electrically coupled to the motor controller through two other cables.

5. The actuating mechanism according to claim 4, wherein the wireless adapter is disposed adjacent to the power supply in the first configuration.

6. The actuating mechanism according to claim 4, wherein the two other cables are permanently attached to the wireless adapter, or detachably connected with the wireless adapter via connectors.

7. The actuating mechanism according to claim 1, wherein the motor controller and the electric motor are spaced apart from each other and are electrically coupled to each other via a cable in the first configuration and the second configuration.

8. The actuating mechanism according to claim 1, wherein the wireless adapter is operable to receive electric power from the power supply through the first cable and transmit the electric power to the motor controller through another cable in the first configuration.

9. The actuating mechanism according to claim 1, further comprising a plurality of winding units and a rotary shaft, the rotary shaft being respectively coupled rotationally to the winding units and an output of the electric motor.

10. The actuating mechanism according to claim 1, wherein the wireless adapter in the first configuration is operable to transmit an electric signal from the wired control interface to the motor controller, or to convert a wireless signal emitted from a wireless control interface to an electric signal and then transmit the electric signal to the motor controller.

11. The actuating mechanism according to claim 1, wherein the wired control interface comprises a plurality of buttons operable to control operation of the actuating mechanism.

12. A window shade comprising:

a fixed rail, a movable rail, and a shading structure disposed between the fixed rail and the movable rail;

an elongate tube pivotally connected with the fixed rail, the elongate tube extending generally vertically from the fixed rail; and the actuating mechanism according to claim 1, wherein the wired control interface is disposed adjacent to a lower end of the elongate tube.

13. The window shade according to claim 12, wherein the electric motor and the power supply of the actuating mechanism are respectively disposed adjacent to two opposite ends of the fixed rail.

* * * * *